US008001882B2

(12) United States Patent
Hyang

(10) Patent No.: US 8,001,882 B2
(45) Date of Patent: Aug. 23, 2011

(54) DOUBLE CHECK VALVE HAVING FLOATING FUNCTION

(75) Inventor: Tae In Hyang, Busan (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 532 days.

(21) Appl. No.: 12/207,804

(22) Filed: Sep. 10, 2008

(65) Prior Publication Data

US 2009/0078111 A1 Mar. 26, 2009

(30) Foreign Application Priority Data

Sep. 20, 2007 (KR) ..... 10-2007-0095963

(51) Int. Cl.
*F15B 13/01* (2006.01)
*E02F 3/84* (2006.01)

(52) U.S. Cl. ..... 91/437; 91/447; 91/464

(58) Field of Classification Search ..... 91/437, 91/445, 446, 447, 464
See application file for complete search history.

(56) References Cited

U.S. PATENT DOCUMENTS 3,274,902 A * 9/1966 Kleckner ..... 91/420
3,908,515 A * 9/1975 Johnson ..... 91/447
4,286,432 A * 9/1981 Burrows et al. ..... 91/461
5,036,750 A * 8/1991 Katayama ..... 91/445
6,997,210 B2 * 2/2006 Horn et al. ..... 91/464
2008/0121101 A1 * 5/2008 Park ..... 91/446

* cited by examiner

*Primary Examiner* — Thomas E Lazo
(74) *Attorney, Agent, or Firm* — Ladas & Parry LLP

(57) ABSTRACT

A double check valve having a floating function is disclosed, which can prevent construction equipment from overturning through intercepting of a floating function even if a signal pressure is fed to the double check valve to perform the floating function in a state that an excavator is supported by a working device (e.g. a dozer blade), i.e. in a jack-up state, on a sloping site and so on. The double check valve includes a hydraulic pump; a hydraulic cylinder connected to the hydraulic pump to operate a working device; a control valve installed in flow paths between the hydraulic pump and the hydraulic cylinder, and shifted to control a start, a stop, and a direction change of the hydraulic cylinder; and a double check valve installed in flow paths between the control valve and the hydraulic cylinder, and including a pair of plungers having first diaphragms formed thereon to receive an operating pressure being applied to the hydraulic cylinder and second diaphragms formed thereon to receive a signal pressure being applied to the signal pressure flow path, and a pair of check valves being pressed to remove their check function through shifting of the plungers. Sectional areas of the first diaphragms and the second diaphragms are different from each other.

2 Claims, 10 Drawing Sheets

DOUBLE CHECK VALVE HAVING FLOATING FUNCTION

CROSS-REFERENCE TO RELATED APPLICATION

This application is based on and claims priority from Korean Patent Application No. 10-2007-0095963, filed on Sep. 20, 2007 in the Korean Intellectual Property Office, the disclosure of which is incorporated herein in its entirety by reference.

BACKGROUND OF THE INVENTION

1. Field of the Invention

The present invention relates to a double check valve having a floating function, which can prevent construction equipment from overturning through intercepting of a floating function even if a signal pressure is fed to the double check valve to perform the floating function in a state that an excavator is supported by a working device (e.g. a dozer blade), i.e. in a jack-up state, on a sloping site and so on.

The term "floating" function means that a working device in a non-load state (that a large chamber and a small chamber of a hydraulic cylinder for operating the working device (e.g. a dozer blade) are connected to each other) is operated depending on the ruggedness of a work surface or road surface in a state that the supply of hydraulic fluid from a hydraulic pump to the hydraulic cylinder is temporarily intercepted.

2. Description of the Prior Art

As shown in FIGS. 1 to 5, the construction equipment having a conventional double check valve includes a hydraulic pump p; a hydraulic cylinder d connected to the hydraulic pump p to operate a working device (e.g. a dozer blade) f; a control valve a installed in flow paths between the hydraulic pump p and the hydraulic cylinder d and shifted to control a start, a stop, and a direction change of the hydraulic cylinder d; and a double check valve k installed in flow paths between the control valve a and the hydraulic cylinder d, and having a pair of plungers h1 and h2 dividedly formed to be shifted in directions opposite to each other when a signal pressure is fed from an outside, and a pair of check valves b1 and b2 (in which check balls are used) pressed through a shifting of the plungers h1 and h2 to remove their check functions.

In this case, the double check valve k includes a housing m in which first flow paths s1 and s3 for connecting the control valve a to a small chamber d2 of the hydraulic cylinder d and second flow paths s2 and s4 for connecting the control valve a to a large chamber d1 of the hydraulic cylinder d are formed; a signal pressure flow path j into which a pilot signal pressure for shifting the plungers h1 and h2 flows from a pilot pump Pp; a pressing member f1 for pressing the check valve b1 for opening/closing the first flow paths s1 and s3; a first elastic member e1 for elastically supporting the pressing member f1 so as to elastically bias the first flow paths s1 and s3, which have been blocked by the check valve b1, to their initial states; a pressing member f2 for pressing the check valve b2 for opening/closing the second flow paths s2 and s4; and a second elastic member e2 for elastically supporting the pressing member f2 so as to elastically bias the second flow paths s2 and s4, which have been blocked by the check valve b2, to their initial states.

As shown in FIG. 2, when the control valve a is kept in a neutral state, the double check valve k serves as a check valve through the check valves b1 and b2 elastically supported by the first and second elastic members e1 and e2 and the pressing members f1 and f2. At this time, the pair of plungers h1 and h2 dividedly formed are kept in close contact with each other.

Specifically, the check valve b1 blocks first flow paths s1 and s3 for connecting the control valve a to the small chamber d2 of the hydraulic cylinder d, and the check valve b2 blocks the second flow paths S2 and s4 for connecting the control valve a to the large chamber d1 of the hydraulic cylinder d.

Accordingly, the hydraulic fluid bed from the hydraulic pump p is not supplied to the hydraulic cylinder d. Also, the hydraulic fluid fed from the hydraulic cylinder d is not returned to a hydraulic tank.

Thus, the dozer blade f of the equipment is prevented from sinking.

As shown in FIG. 3, when the control valve a is shifted in a right direction by a signal pressure being applied from an outside, the hydraulic fluid fed from the hydraulic pump p is supplied to the first flow path s1 of the double check valve k through the control valve a. At this time, the pair of plungers h1 and h2 dividedly formed, which are in close contact with each other, are slidably moved to be shifted in a left direction.

The hydraulic fluid in the first flow path s1 acts upon a diaphragm n1 to shift the plungers h1 and h2 in the left direction as shown in the drawing, and presses the check valve b1 to remove its check function, so that the first flow paths s1 and s3 are connected to each other. Accordingly, the hydraulic fluid from the hydraulic pump p is supplied to the small chamber d2 of the hydraulic cylinder d after passing through the control valve a and the first flow paths s1 and s3 in order.

Simultaneously, due to the shifting of the plungers h1 and h2 which are in close contact with each other, the check valve b2 is pressed to remove its check function, so that the second flow paths s2 and s4 are connected to each other. Accordingly, the hydraulic fluid from the large chamber d1 of the hydraulic cylinder d is returned to the hydraulic tank after passing through the second flow paths s2 and s4 and the control valve a in order.

Accordingly, the hydraulic cylinder d is driven to be contracted.

As shown in FIG. 4, when the control valve a is shifted in the left direction by a signal pressure being fed from an outside, the hydraulic fluid fed from the hydraulic pump p is supplied to the second flow path s2 of the double check valve k through the control valve a. At this time, the pair of plungers h1 and h2 dividedly formed, which are in close contact with each other, are slidably moved to be shifted in the right direction.

The hydraulic fluid in the second flow path s2 acts upon a diaphragm n2 to shift the plungers h1 and h2 in the right direction as shown in the drawing, and presses the check valve b2 to remove its check function, so that the second flow paths s2 and s4 are connected to each other. Accordingly, the hydraulic fluid fed from the hydraulic pump p is supplied to the large chamber d1 of the hydraulic cylinder d after passing through the control valve a and the second flow paths s2 and s4 in order.

Simultaneously, due to the shifting of the plungers h1 and h2, the check valve b1 is pressed to remove its check function, so that the second flow paths s2 and s4 are connected to each other. Accordingly, the hydraulic fluid from the small chamber d2 of the hydraulic cylinder d is returned to the hydraulic tank after passing through the first flow paths s1 and s3 and the control valve a in order.

Accordingly, the hydraulic cylinder d is driven to be extended.

FIG. 5 is a view illustrating the use state of a double check valve when a control valve a is shifted to a neutral state and the floating function of the dozer blade f is selected.

When the pilot signal pressure from the hydraulic pump Pp is applied to the signal pressure flow path j formed in the check valve k, the plungers h1 and h2 dividedly formed are simultaneously shifted in opposite directions to each other.

Specifically, as the plunger h1 is shifted in the right direction as shown in the drawing by the pilot signal pressure acting upon the diaphragm n3 of the plunger h1, the check valve b is pressed in the right direction to remove its check function (at this time, the first elastic member e1 receives the compression force). That is, the first flow paths s1 and s3 of the double check valve k are connected to each other.

Simultaneously, as the plunger h2 is shifted in the left direction as shown in the drawing by the pilot signal pressure acting upon the diaphragm n4 of the plunger h2, the check valve c is pressed in the left direction to remove its check function (at this time, the second elastic member e2 receives the compression force). That is, the second flow paths s2 and s4 of the check valve k are connected to each other.

Accordingly, the control valve a and the small chamber d2 of the hydraulic cylinder d are connected to each other by the first flow paths s1 and s3, and the control valve a and the large chamber d1 of the hydraulic cylinder d are connected to each other by the second flow paths s2 and s4.

Accordingly, the small chamber d2 and the large chamber d1 of the hydraulic cylinder d are connected to each other. That is, in the case where the hydraulic fluid fed from the large chamber d1 of the hydraulic cylinder d in a non-load state is transferred to the small chamber d2 of the hydraulic cylinder d (as indicated by an arrow) after passing through the second flow paths s4 and s2, the control valve a, and the first flow paths s1 and s3 in order, the hydraulic cylinder d is driven to be contracted.

By contrast, in the case where the hydraulic fluid fed from the small chamber d2 of the hydraulic cylinder d in a non-load state is transferred to the large chamber d1 of the hydraulic cylinder d (as indicated by an arrow) after passing through the first flow paths s3 and s1, the control valve a second flow paths s4 and s2, the control valve a, and the second flow paths s2 and s4 in order, the hydraulic cylinder d is driven to be extended.

Consequently, in the case where the equipment having the dozer blade f mounted thereon travels along the ground, the displacement of the hydraulic cylinder d in a non-load state is automatically adjusted depending on the ruggedness of the ground, and thus the floating function can be performed.

By contrast, when the pilot signal pressure from the hydraulic pump Pp is applied to the signal pressure flow path j in a state that high pressure is produced in the small chamber d2 or the large chamber d1 of the hydraulic cylinder d, the flow paths S1, s3, s2, and s4 of the double check valve k are connected to each other, and this may cause an abrupt operation of the cylinder d.

For example, it is exemplified that the double check valve k is used to prevent the dozer blade f of the excavator from sinking. In this case, when the pilot signal pressure is applied from the outside to the signal pressure flow path j in order to perform the floating function of the dozer blade f, sectional areas of the diaphragms n1, n3, n2, and n4 become equal to each other, and thus the floating function is performed regardless of the shifted state of the hydraulic cylinder d.

At this time, if the excavator is supported by the dozer blade f, i.e. if the excavator is in a jack-up state, on a sloping site and so on, the equipment may overturn due to an abrupt sinking of the hydraulic cylinder d, and this may cause components of the excavator to be damaged or cause a safety accident to occur to injure an operator.

SUMMARY OF THE INVENTION

Accordingly, the present invention has been made to solve the above-mentioned problems occurring in the prior art while advantages achieved by the prior art are maintained intact.

One object of the present invention is to provide a double check valve having a floating function, which can prevent construction equipment from overturning through intercepting of a floating function even if a signal pressure is fed to the double check valve to perform the floating function in a state that an excavator is supported by a working device (e.g. a dozer blade), i.e. in a jack-up state, on a sloping site and so on.

In order to accomplish these objects, there is provided a double check valve having a floating function, according to one aspect of the present invention, which includes a hydraulic pump; a hydraulic cylinder connected to the hydraulic pump to operate a working device; a control valve installed in flow paths between the hydraulic pump and the hydraulic cylinder, and shifted to control a start, a stop, and a direction change of the hydraulic cylinder; and a double check valve installed in flow paths between the control valve and the hydraulic cylinder, and including a pair of plungers dividedly formed to be shifted in directions opposite to each other when a signal pressure is applied from an outside to a signal pressure flow path, and having first diaphragms formed thereon to receive an operating pressure being applied to the hydraulic cylinder and second diaphragms formed thereon to receive a signal pressure being applied to the signal pressure flow path in order to perform a floating function of the working device, sectional areas of the first diaphragms and the second diaphragms being different from each other, and a pair of check valves being pressed to remove their check function through shifting of the plungers, wherein, if the signal pressure is applied from the outside to the signal pressure flow path and the operating pressure in the hydraulic cylinder is lower than a predetermined pressure, the check function of the check valves is removed, while if the signal pressure is applied from the outside to the signal pressure flow path and the operating pressure in the hydraulic cylinder is higher than the predetermined pressure, the check function of the check valves is maintained.

The double check valve may include a housing in which first flow paths for connecting the control valve to the small chamber of the hydraulic cylinder, second flow paths for connecting the control valve to the large chamber of the hydraulic cylinder, and the signal pressure flow path, into which a signal pressure for shifting the plungers is applied from an outside, are formed; a pressing member for pressing the check valve for opening/closing the first flow paths; a first elastic member for elastically supporting the pressing member so as to elastically bias the first flow paths, which have been blocked by the check valve, to their initial states; a pressing member for pressing the check valve for opening/closing the second flow paths; and a second elastic member for elastically supporting the pressing member so as to elastically bias the second flow paths, which have been blocked by the check valve, to their initial states.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
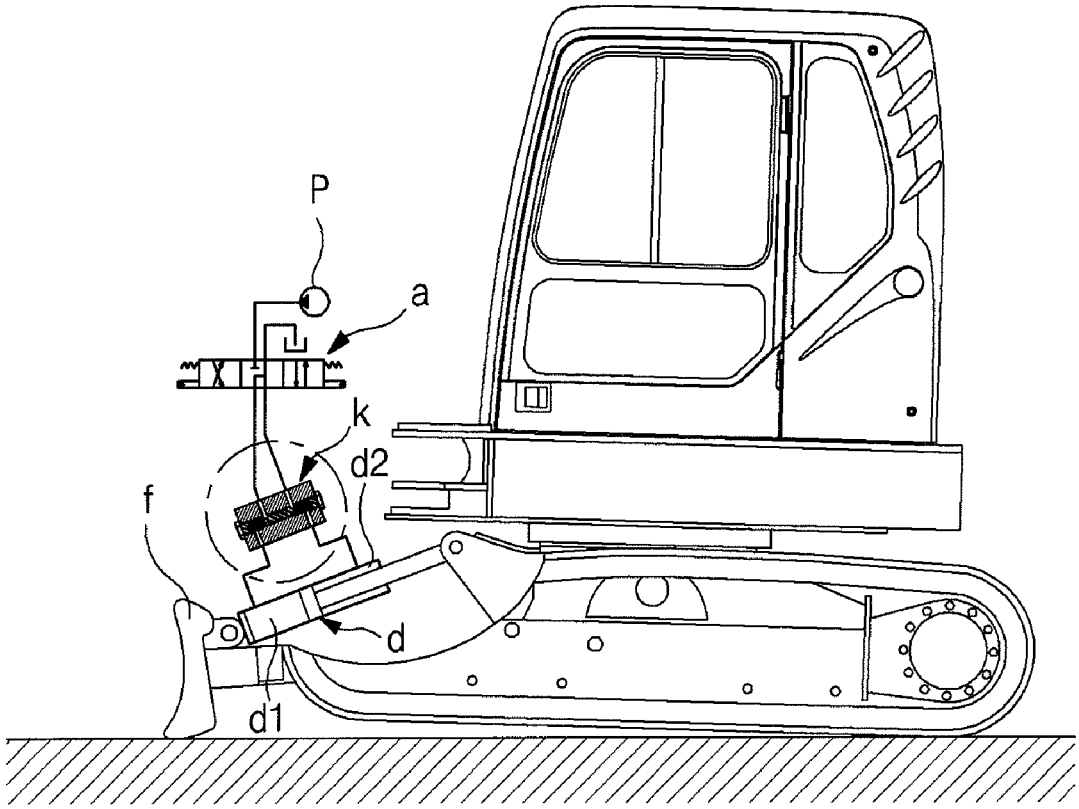
Fig. 1 Prior Art
FIG. 1 is a schematic view of construction equipment having a conventional double check valve installed thereon.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

As shown in FIGS. 6 to 10, a double check valve having a floating function according to an embodiment of the present invention includes a hydraulic pump p; a hydraulic cylinder d connected to the hydraulic pump P to operate a working device (e.g. dozer blade); a control valve a installed in flow paths between the hydraulic pump p and the hydraulic cylinder d and shifted to control a start, a stop, and a direction change of the hydraulic cylinder d; and a double check valve k installed in flow paths between the control valve a and the hydraulic cylinder d, and including a pair of plungers x1 and x2 dividedly formed to be shifted in directions opposite to each other when a signal pressure is applied from an outside to a signal pressure flow path j, and having first diaphragms n1 and n2 formed thereon to receive an operating pressure being applied to the hydraulic cylinder d and second diaphragms n5 and n6 formed thereon to receive a signal pressure being applied to the signal pressure flow path j in order to perform a floating function of the working device, sectional areas of the first diaphragms n1 and n2 and the second diaphragms n5 and n6 being different from each other, and a pair of check valves b1 and b2 being pressed to remove their check function through shifting of the plungers x1 and x2.

In this case, if the signal pressure is applied from a pilot pump Pp to the signal pressure flow path j and the operating pressure in the hydraulic cylinder d is lower than a predetermined pressure, the check function of the check valves b1 and b2 is removed, while if the signal pressure is applied from the outside to the signal pressure flow path j and the operating pressure in the hydraulic cylinder d is higher than the predetermined pressure, the check function of the check valves b1 and b2 is maintained.

That is, a pilot ratio of an external operating pressure (i.e. a ratio of an operating pressure of the hydraulic cylinder d to a pilot pressure from the pilot pump Pp) and a pilot ratio of the check valve (i.e. a ratio of an operating pressure of the hydraulic cylinder d to a supplied pressure from the hydraulic pump p) are set to be different from each other.

Accordingly, if the signal pressure form the pilot pump Pp is applied to the signal pressure flow path j in order to perform a floating function of a working device and a load occurs in the hydraulic cylinder, the check function of the check valves b1 and b2 is maintained, and the floating function of the working device is not performed to prevent the equipment from overturning.

The double check valve k may further include a housing m in which first flow paths s1 and s3 for connecting the control valve a to the small chamber d2 of the hydraulic cylinder d, second flow paths s2 and s4 for connecting the control valve a to the large chamber d1 of the hydraulic cylinder d, and the signal pressure flow path j, into which a signal pressure for shifting the plungers x1 and x2 is applied from the pilot pump Pp, are formed; a pressing member f1 for pressing the check valve b1 for opening/closing the first flow paths s1 and s3; a first elastic member e1 for elastically supporting the pressing member f1 so as to elastically bias the first flow paths s1 and s3, which have been blocked by the check valve b1, to their initial states; a pressing member f2 for pressing the check valve b2 for opening/closing the second flow paths s2 and s4; and a second elastic member e2 for elastically supporting the pressing member f2 so as to elastically bias the second flow paths s2 and s4, which have been blocked by the check valve b2, to their initial states.

Figure 2:
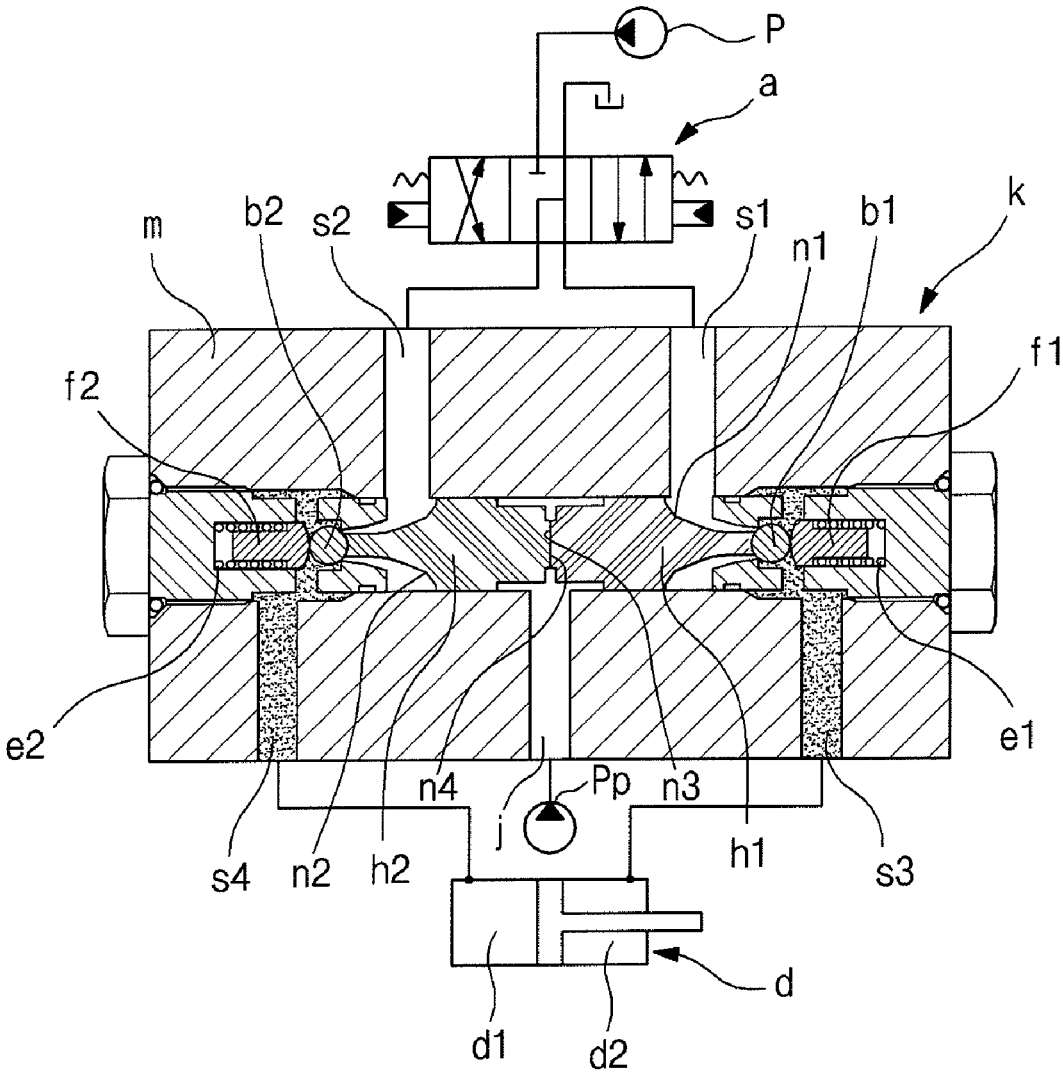
Fig. 2 Prior Art
FIG. 2 is a view illustrating the use state of a double check valve when a control valve as illustrated in FIG. 1 is in a neutral state.
Figure 3:
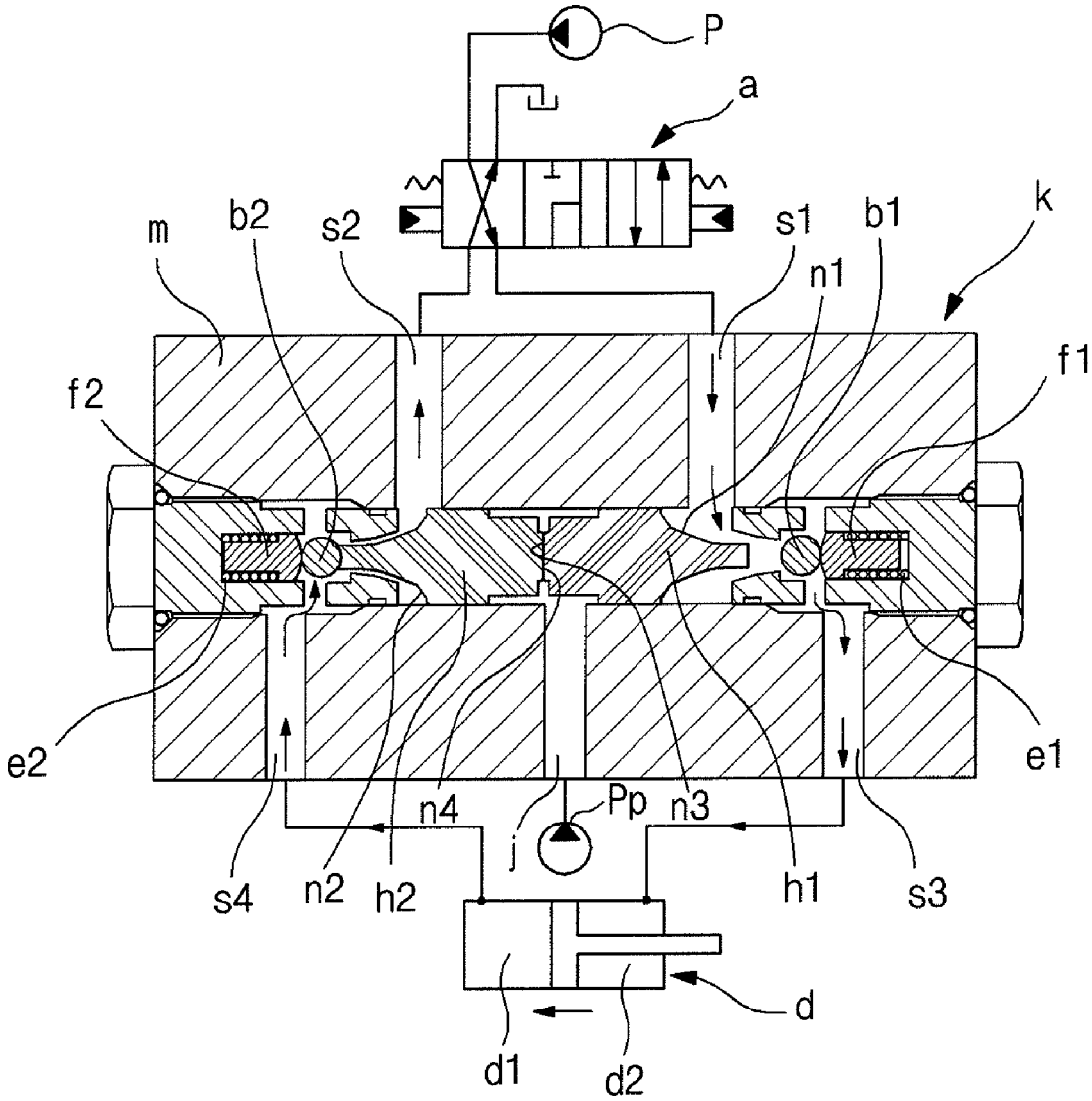
Fig. 3 Prior Art
FIG. 3 is a view illustrating the use state of a double check valve when a control valve as illustrated in FIG. 1 is shifted.

In this case, the construction including the hydraulic pump p, the control valve a, the hydraulic cylinder d, and the like, is substantially the same as that as illustrated in FIG. 2, and thus the detailed description thereof will be omitted. In the following description, the same drawing reference numerals are used for the same elements among/across various figures.

Hereinafter, the operation of the double check valve having a floating function according to an embodiment of the present invention will be described with reference to the accompanying drawings.

Figure 6:
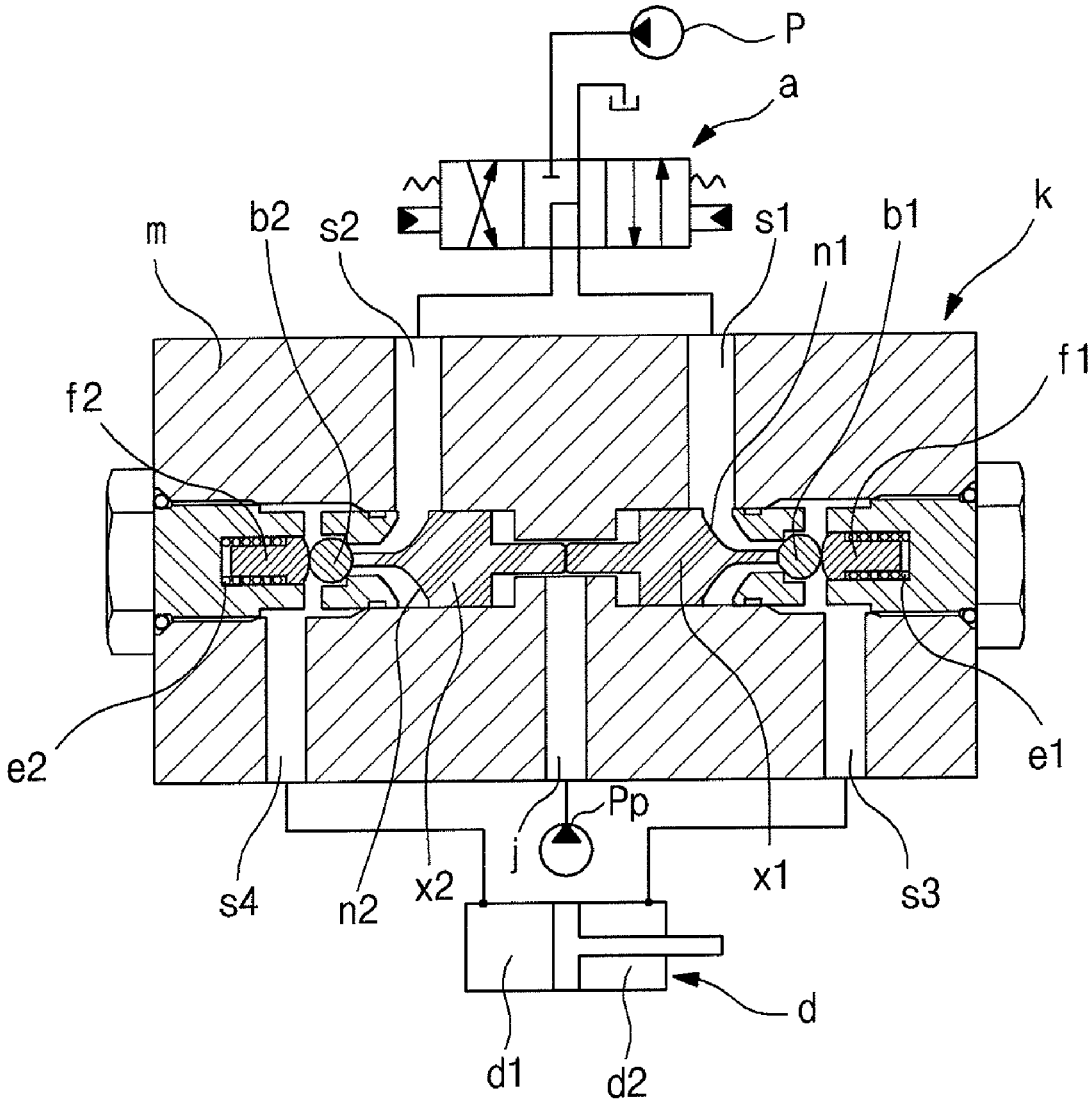
FIG. 6 is a schematic view of a double check valve having a floating function according to an embodiment of the present invention.

As shown in FIG. 6, when the control valve a is kept in a neutral state, the double check valve k serves as a check valve through the check valves bb and b2 elastically supported by the first and second elastic members e1 and e2 and the pressing members f1 and f2. In this case, the pair of plungers x1 and x2 dividedly formed are kept in close contact with each other.

Specifically, the check valve b1 blocks the first flow paths s1 and s3 that connect the control valve a to the small chamber d2 of the hydraulic cylinder d, and the check valve b2 blocks the second flow paths S2 and s4 that connect the control valve a to the large chamber d1 of the hydraulic cylinder d.

Accordingly, the hydraulic fluid fed from the hydraulic pump p is not supplied to the hydraulic cylinder d. Also, the hydraulic fluid fed from the hydraulic cylinder d is not returned to the hydraulic tank.

Figure 7:
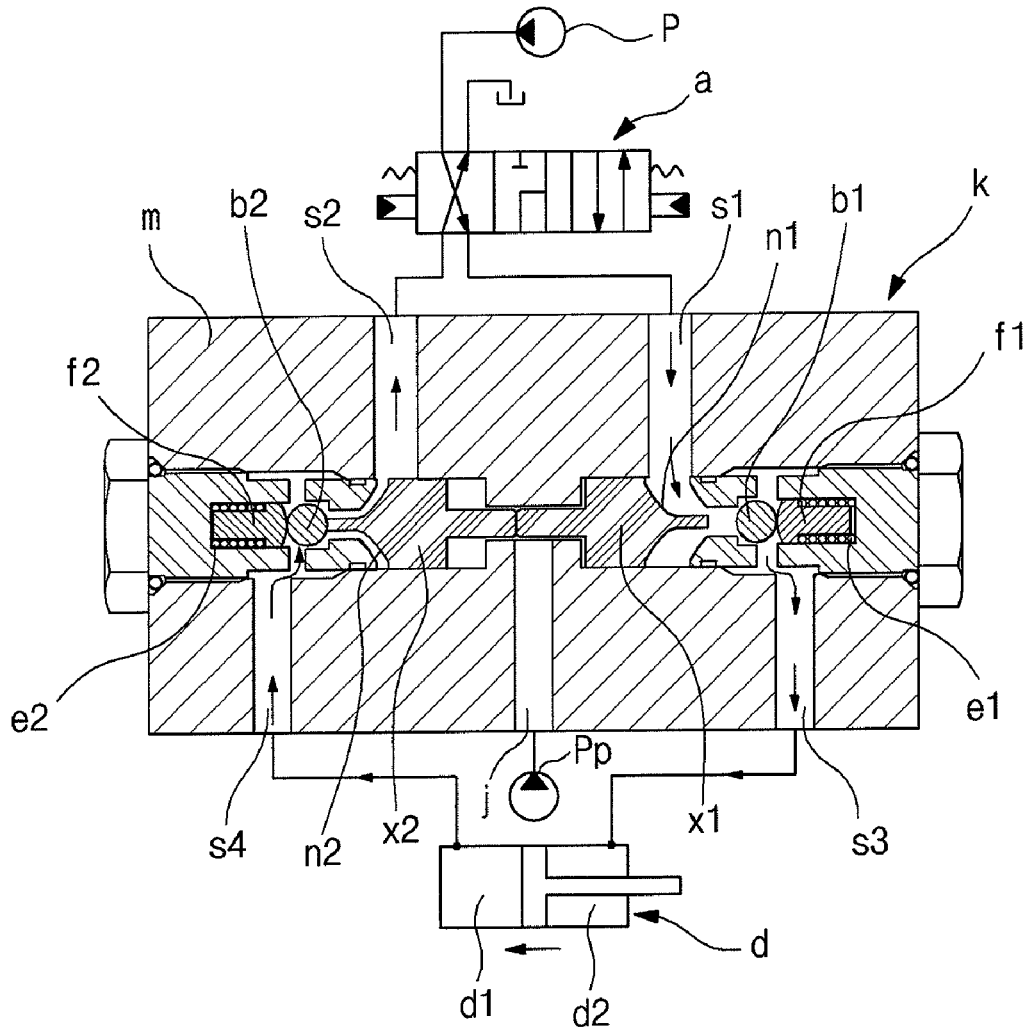
FIG. 7 is a view illustrating a double check valve which is driven to be contracted when a control valve as illustrated in FIG. 6 is shifted.

As shown in FIG. 7, when the control valve a is shifted in the right direction, the hydraulic fluid fed from the hydraulic pump p is supplied to the first flow path s1 of the double check valve k through the control valve a. In this case, the pair of plungers x1 and x2 dividedly formed, which are kept in close contact with each other, are slidably moved and shifted in the left direction.

As the hydraulic fluid in the second flow path s1 acts upon the diaphragm n1 to shift the plungers x1 and x2 in the left direction as shown in the drawing, the check valve b1 is pressed to remove its check function, and the first flow paths s1 and s3 are connected to each other. Accordingly, the hydraulic fluid fed from the hydraulic pump p is supplied to the small chamber d2 of the hydraulic cylinder d after passing through the control valve a and the first flow paths s1 and s3 in order.

Simultaneously, due to the shifting of the plungers x1 and x2, the check valve b2 is pressed to remove its check function, and the second flow paths s2 and s4 are connected to each other. Accordingly, the hydraulic fluid fed from large chamber d1 of the hydraulic cylinder d is returned to the hydraulic tank after passing through the second flow paths s2 and s4 and the control valve a in order.

Figure 4:
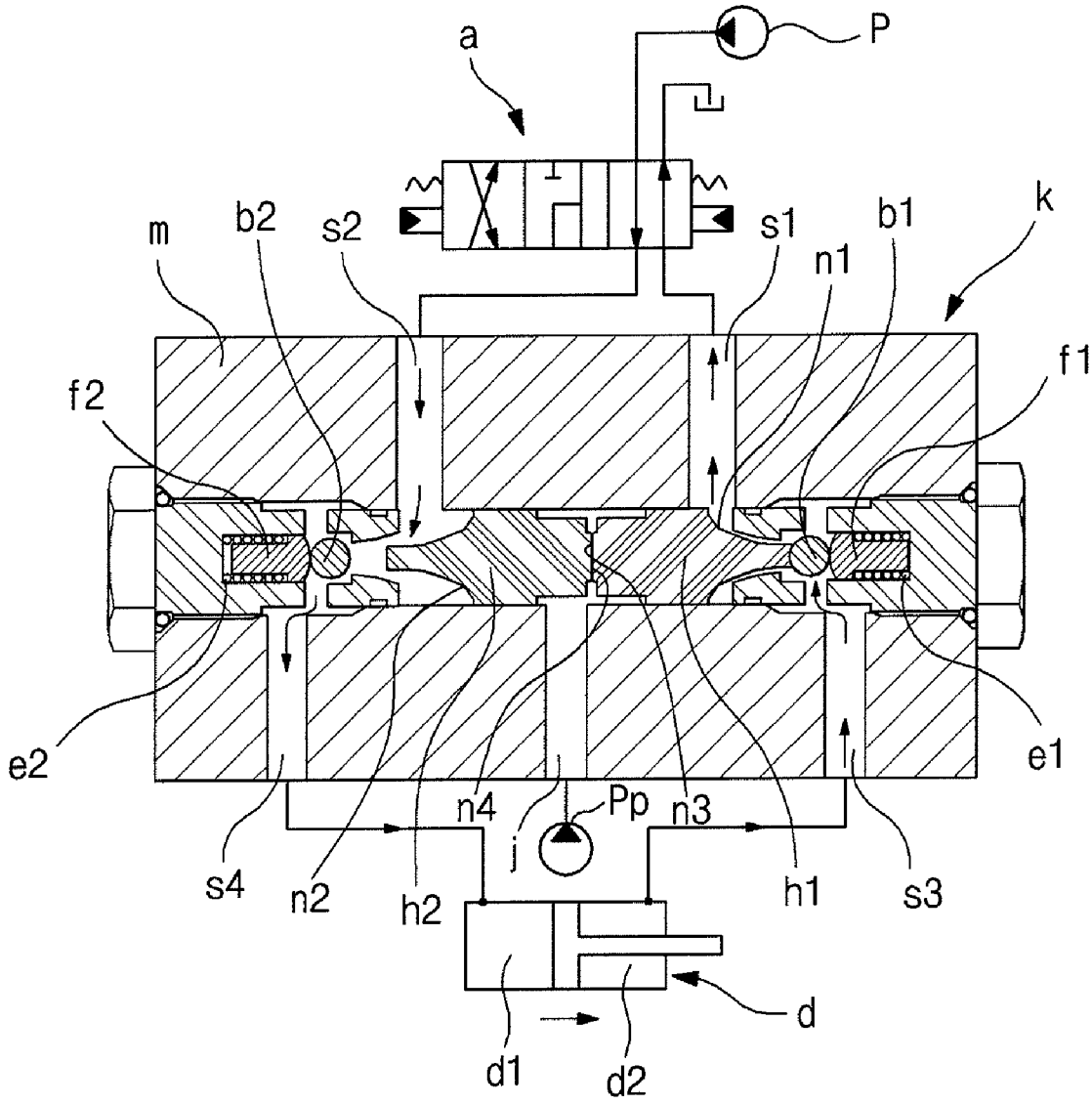
Fig. 4 Prior Art
FIG. 4 is a view illustrating the use state of a double check valve when a control valve as illustrated in FIG. 1 is shifted.
Figure 5:
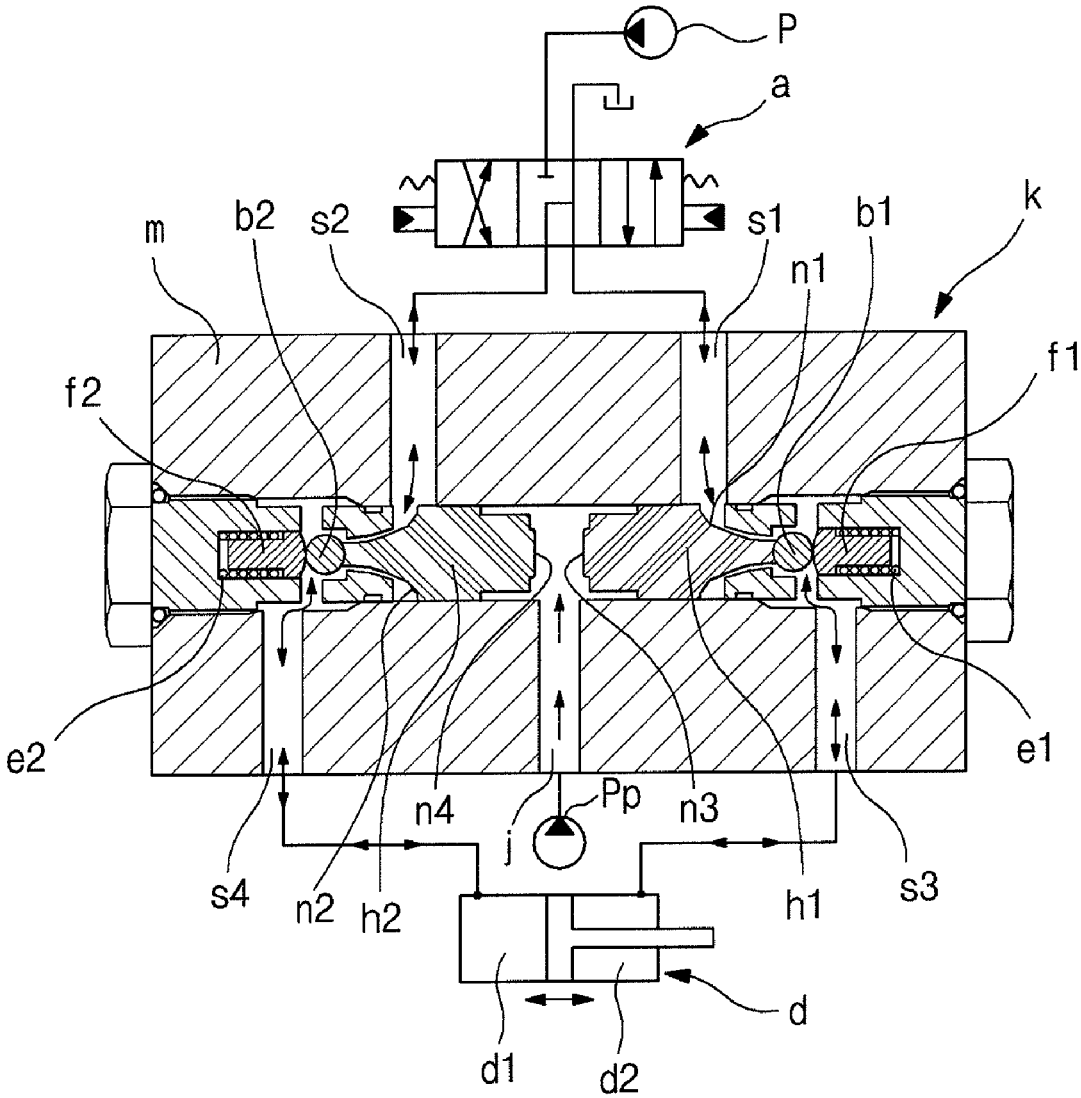
Fig. 5 Prior Art
FIG. 5 is a view illustrating the use state of a double check valve when a control valve as illustrated in FIG. 1 is in a neutral state and an external pressure is supplied.

Although not illustrated in the drawing, when the control valve a is shifted in the left direction, the hydraulic fluid fed from the hydraulic pump p is supplied to the large chamber d1 of the hydraulic cylinder d due to the shifting of the plungers x1 and x2, in the same manner as described with reference to FIG. 4, and thus the detailed description thereof will be omitted.

Figure 8:
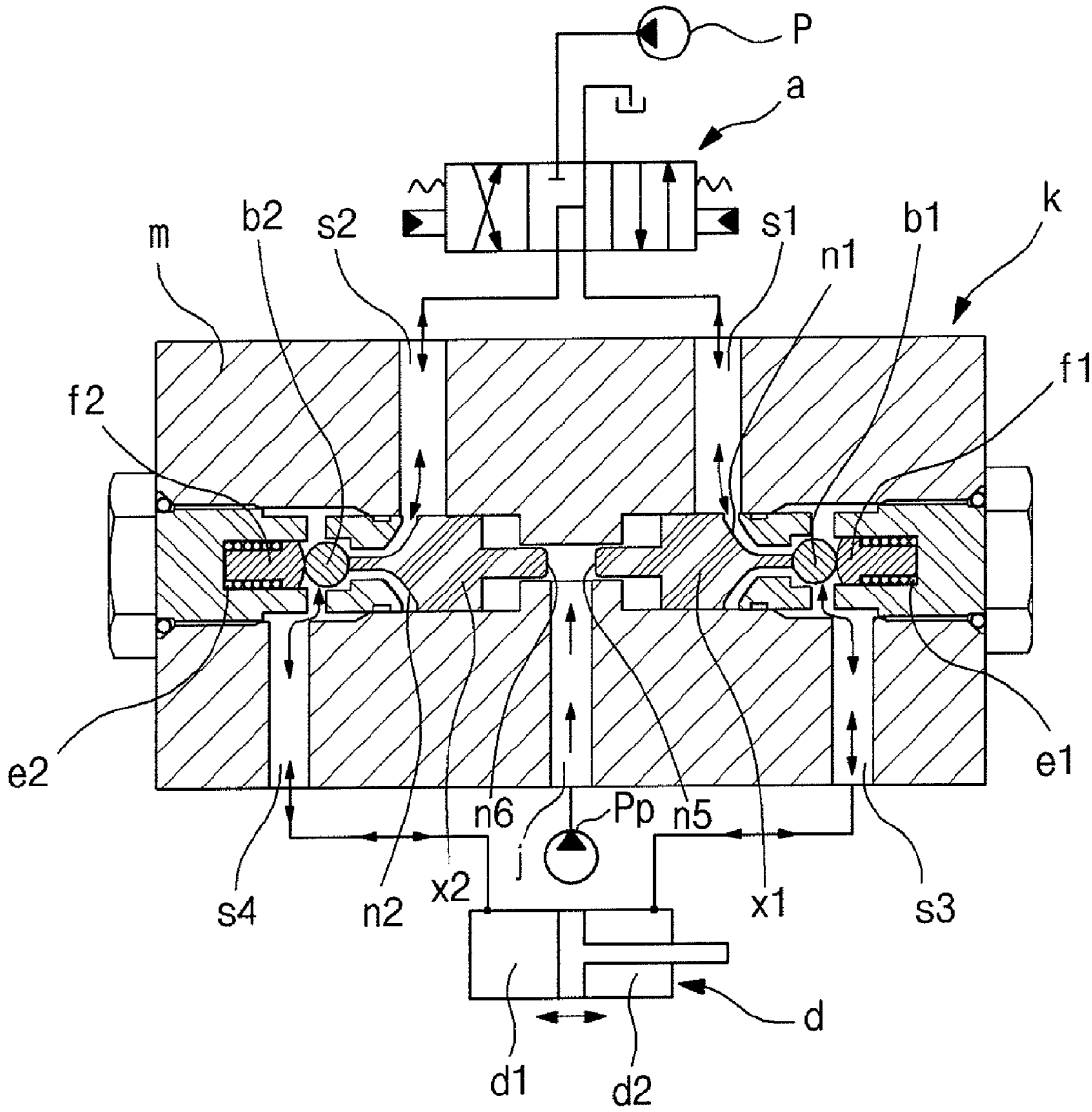
FIG. 8 is a view illustrating a double check valve which performs a floating function of a working device due to the shifting of plungers when a control valve and a hydraulic cylinder as illustrated in FIG. 6 are in a neutral state.

FIG. 8 is a view illustrating the use state of the double check valve when the control valve a is shifted to a neutral state and the floating function of the working device (e.g. dozer blade) is selected.

When the pilot signal pressure from the hydraulic pump Pp is applied to the signal pressure flow path j, the plungers x1 and x2 dividedly formed are simultaneously shifted in directions opposite to each other.

As the plunger x1 is shifted in the right direction as shown in the drawing by the pilot signal pressure acting upon the diaphragm n5 of the plunger x1, the check valve b1 is pressed in the right direction to remove its check function (at this time, the first elastic member e1 receives a compression force). That is, the first flow paths s1 and s3 of the double check valve k are connected to each other.

Simultaneously, as the plunger x2 is shifted in the left direction as shown in the drawing by the pilot signal pressure acting upon the diaphragm n6 of the plunger x2, the check valve b2 is pressed in the left direction to remove its check function (at this time, the second elastic member e2 receives a compression force). That is, the second flow paths s2 and s4 of the double check valve k are connected to each other.

In this case, since the sectional areas of the diaphragms n5 and n6, which receive the pilot pressure fed to the signal pressure flow path j, are formed to be small (i.e. the sectional areas of the diaphragms n5 and n6 are relatively smaller than those of the diaphragms n1 and n2, which receive the operating pressure fed to the hydraulic cylinder d), the check function of the check valves b1 and b2 is removed only in the case where the operating pressure of the hydraulic cylinder d is lower than a predetermined pressure.

Accordingly, the control valve a and the small chamber d2 of the hydraulic cylinder d are connected to each other by the first flow paths s1 and s3, and the control valve a and the large chamber d1 of the hydraulic cylinder d are connected to each other by the second flow paths s2 and s4.

Accordingly, the small chamber d2 and the large chamber d1 of the hydraulic cylinder d are connected to each other. That is, in the case where the hydraulic fluid fed from the large chamber d1 of the hydraulic cylinder d in a non-load state is transferred to the small chamber d2 of the hydraulic cylinder d (as indicated by an arrow) after passing through the second flow paths s4 and s2, the control valve a, and the first flow paths s1 and s3 in order, the hydraulic cylinder d is driven to be contracted.

By contrast, in the case where the hydraulic fluid fed from the small chamber d2 of the hydraulic cylinder d in a non-load state is transferred to the large chamber d1 of the hydraulic cylinder d (as indicated by an arrow) after passing through the first flow paths s3 and s1, the control valve a, and the second flow paths s2 and s4 in order, the hydraulic cylinder d is driven to be extended.

Consequently, in the case where the equipment having the dozer blade mounted thereon travels along the ground, the displacement of the hydraulic cylinder d in a non-load state is automatically adjusted depending on the ruggedness of the ground, and thus the floating function can be performed.

Figure 9:
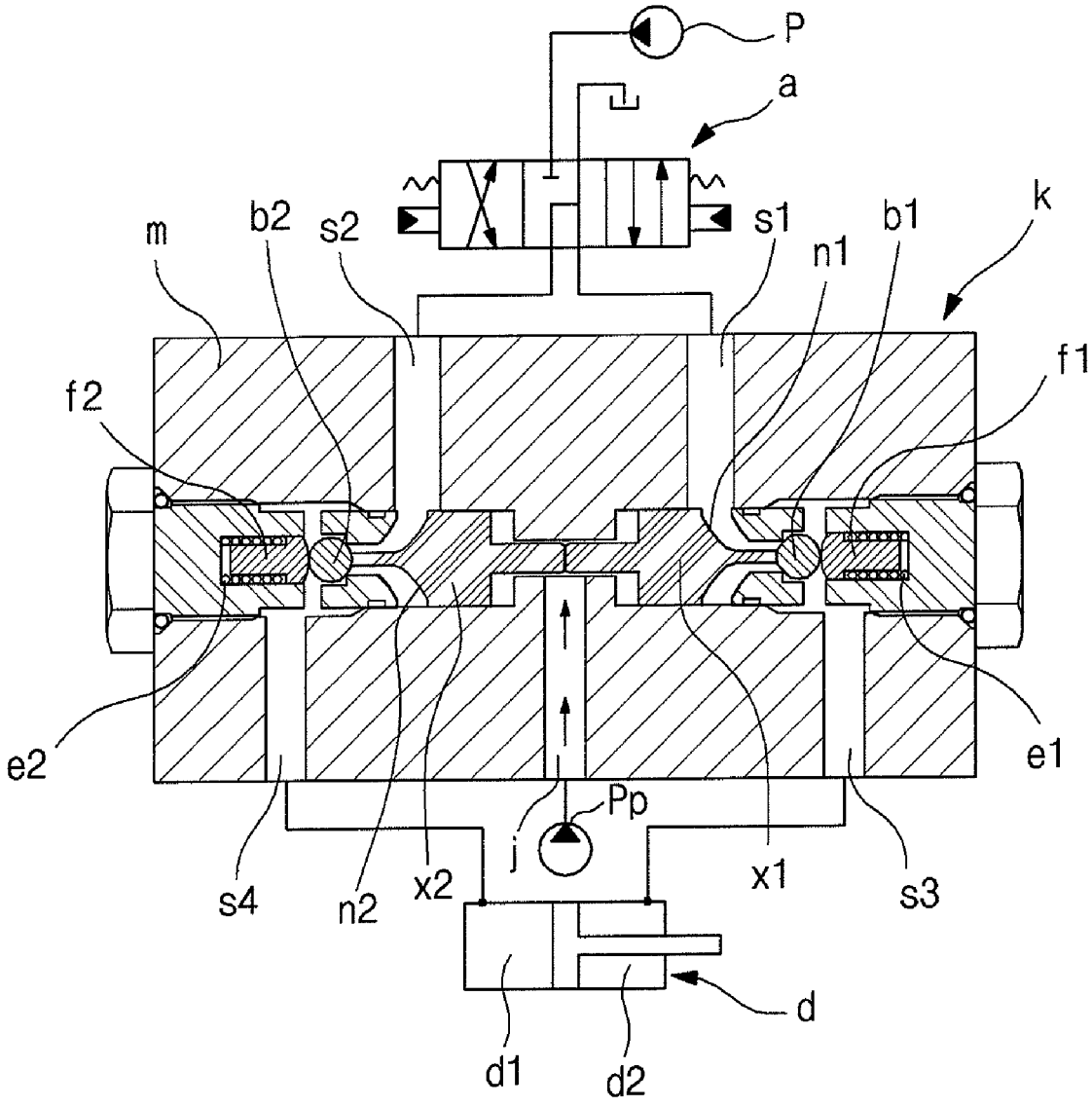
FIG. 9 is a view illustrating a double check valve in which plungers are not shifted when a signal pressure is applied to perform a floating function of a working device in a neutral state of a control valve as illustrated in FIG. 6.

As illustrated in FIG. 9, even in the case where the control valve a is kept in a neutral state and the signal pressure is applied from the pilot pump Pp to the signal pressure flow path j in order to perform the floating function of the working device (e.g. the dozer blade), the check function of the check valves b1 and b2 is maintained.

In the case where the pilot signal pressure from the hydraulic pump Pp is applied to the signal pressure flow path j in order to perform the floating function of the working device, the pair of plungers x1 and x2 dividedly formed are not shifted.

That is, since the sectional areas of the diaphragms n5 and n6, which receive the pilot pressure fed to the signal pressure flow path j, are formed to be small (i.e. the sectional areas of the diaphragms n5 and n6 are relatively smaller than those of the diaphragms n1 and n2, which receive the operating pressure fed to the hydraulic cylinder d), the plungers x1 and x2 are not shifted in the case where the operating pressure of the hydraulic cylinder d is higher than the predetermined pressure, and thus the check function of the check valves b1 and b2 is maintained.

For example, in the case where the ratio of the signal pressure from the pilot pump Pp to the operating pressure of the hydraulic cylinder d is set to 2:1, the pilot signal pressure fed to the signal pressure flow path j is 30 bar, and the operating pressure of the hydraulic cylinder is higher than 60 bar (in the case where a load occurs in the hydraulic cylinder d), the check function of the check valves b1 and b2 is maintained.

Since the check function of the double check valve k is maintained, the floating function of the working device cannot be performed. Accordingly, the overturning of the equipment due to the sinking of the working device (e.g. dozer blade) can be prevented.

Figure 10:
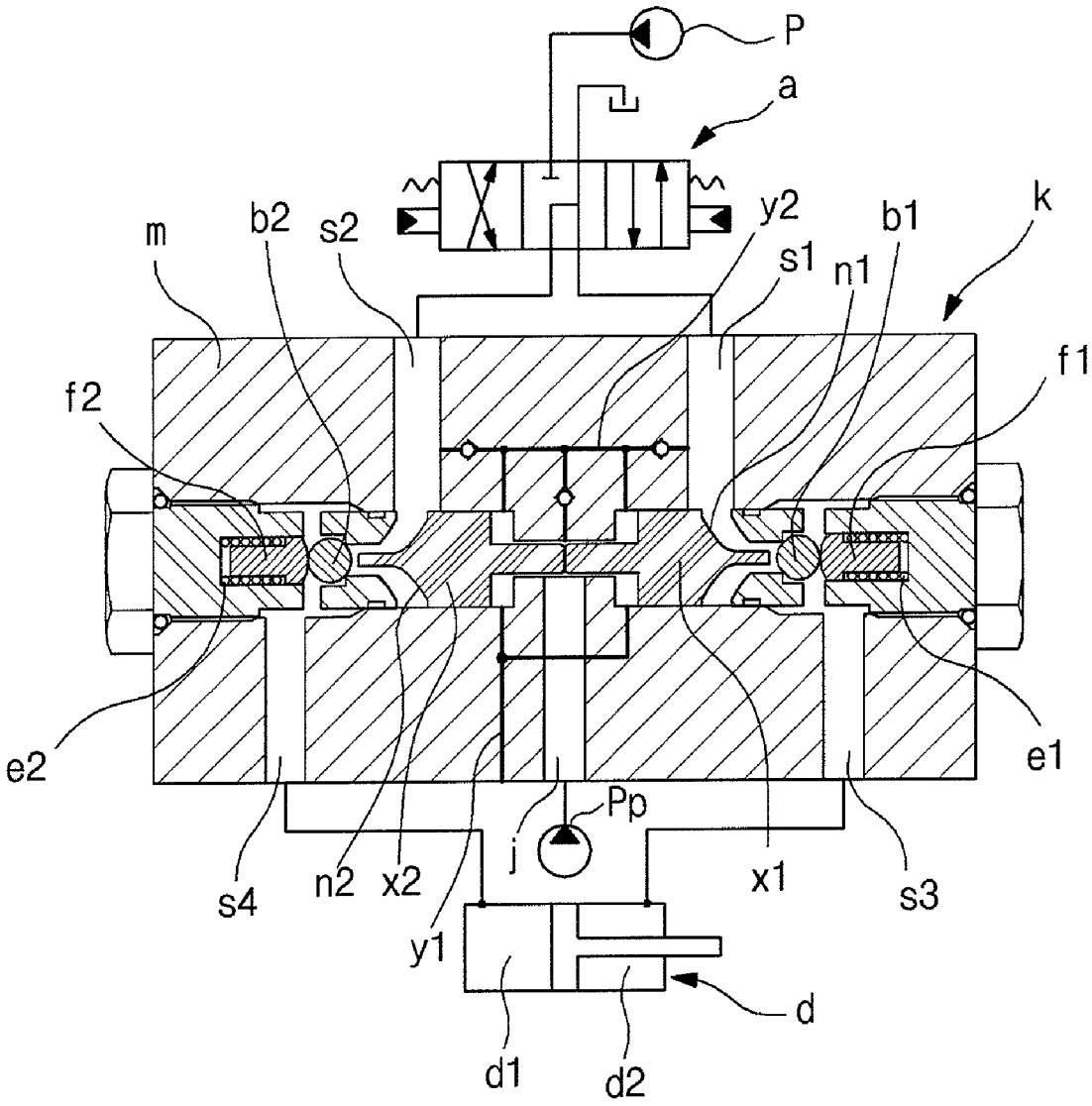
FIG. 10 is a view illustrating the draining state of hydraulic fluid when plungers as illustrated in FIG. 6 are shifted.

As illustrated in FIG. 10, the hydraulic fluid being compressed during the shifting of the plungers x1 and x2 may be discharged to an outside of the housing m through an external drain flow path y1, or may join the hydraulic fluid from the hydraulic pump p or the pilot pump Pp through an internal drain flow path y2.

As described above, the double check valve having a floating function according to an embodiment of the present invention has the following advantages.

Even if a signal pressure is fed to the double check valve to perform the floating function in a state that an excavator is supported by a working device (e.g. a dozer blade), i.e. in a jack-up state, on a sloping site and so on, the check function of the check valves is maintained to intercept the floating function, and thus the overturning of the equipment is prevented. Accordingly, the damage of the equipment and the safety accident that injures an operator can be prevented.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A double check valve having a floating function, comprising:

a hydraulic pump;

a hydraulic cylinder connected to the hydraulic pump to operate a working device;

a control valve installed in flow paths between the hydraulic pump and the hydraulic cylinder, and shifted to control a start, a stop, and a direction change of the hydraulic cylinder; and a double check valve installed in flow paths between the control valve and the hydraulic cylinder, and including a pair of plungers dividedly formed to be shifted in directions opposite to each other when a signal pressure is applied from an outside to a signal pressure flow path, and having first diaphragms formed thereon to receive an operating pressure being applied to the hydraulic cylinder and second diaphragms formed thereon to receive a signal pressure being applied to the signal pressure flow path in order to perform a floating function of the working device, sectional areas of the first diaphragms and the second diaphragms being different from each other, and a pair of check valves being pressed to remove their check function through shifting of the plungers;

wherein, if the signal pressure is applied from the outside to the signal pressure flow path and the operating pressure in the hydraulic cylinder is lower than a predetermined pressure, the check function of the check valves is removed, while if the signal pressure is applied from the outside to the signal pressure flow path and the operating pressure in the hydraulic cylinder is higher than the predetermined pressure, the check function of the check valves is maintained.

2. The double check valve of claim 1, wherein the double check valve comprises:

a housing in which first flow paths for connecting the control valve to the small chamber of the hydraulic cylinder, second flow paths for connecting the control valve to the large chamber of the hydraulic cylinder, and the signal pressure flow path, into which a signal pressure for shifting the plungers is applied from an outside, are formed;

a pressing member for pressing the check valve for opening/closing the first flow paths;

a first elastic member for elastically supporting the pressing member so as to elastically bias the first flow paths, which have been blocked by the check valve, to their initial states;

a pressing member for pressing the check valve for opening/closing the second flow paths; and a second elastic member for elastically supporting the pressing member so as to elastically bias the second flow paths, which have been blocked by the check valve, to their initial states.

* * * * *